US007543686B2

(12) United States Patent
Kulak et al.

(10) Patent No.: US 7,543,686 B2
(45) Date of Patent: Jun. 9, 2009

(54) ELEVATOR WITH ROLLERS HAVING SELECTIVELY VARIABLE HARDNESS

(75) Inventors: Richard Kulak, Bristol, CT (US); Michael Tracey, Cromwell, CT (US)

(73) Assignee: Otis Elevator Company, Farmington, CT (US)

( * ) Notice: Subject to any disclaimer, the term of this patent is extended or adjusted under 35 U.S.C. 154(b) by 187 days.

(21) Appl. No.: 10/552,910

(22) PCT Filed: Apr. 15, 2003

(86) PCT No.: PCT/US03/11596

§ 371 (c)(1),
(2), (4) Date: Oct. 13, 2005

(87) PCT Pub. No.: WO2004/099054

PCT Pub. Date: Nov. 18, 2004

(65) Prior Publication Data

US 2006/0207835 A1 Sep. 21, 2006

(51) Int. Cl.
*B66B 7/04* (2006.01)
*B66B 1/34* (2006.01)

(52) U.S. Cl. ..... 187/292; 187/345

(58) Field of Classification Search ..... 187/292, 187/345, 393, 410

See application file for complete search history.

(56) References Cited

U.S. PATENT DOCUMENTS 5,086,882 A 2/1992 Sugahara et al.
5,289,902 A 3/1994 Fujita
5,289,908 A 3/1994 Fujita
5,632,358 A 5/1997 Maeda et al.
5,810,120 A * 9/1998 Jamieson et al. ..... 187/292
5,824,976 A * 10/1998 Jamieson et al. ..... 187/393
5,864,102 A * 1/1999 Jamieson et al. ..... 187/292
5,929,399 A * 7/1999 Jamieson et al. ..... 187/391
6,109,398 A 8/2000 Lempio et al.
6,338,396 B1 * 1/2002 Morishita ..... 187/292
6,345,698 B1 2/2002 Ravishankar (Continued)

FOREIGN PATENT DOCUMENTS

JP 41-11778 6/1941

(Continued)

OTHER PUBLICATIONS

International Search Report dated Aug. 28, 2003.

(Continued)

*Primary Examiner*—Walter Benson
*Assistant Examiner*—Eduardo Colon
(74) *Attorney, Agent, or Firm*—Carlson, Gaskey & Olds

(57) ABSTRACT

An elevator system includes a roller (16) having a hardness that varies responsive to a magnetic field (20). The roller (16) rolls along a guide rail (28) to maintain a desired orientation of the elevator car (12). In one example, the roller (16) includes a membrane (30) defining a generally annular chamber (36) containing fluid (22) that changes viscosity responsive to changes in the magnetic field (20). The rollers (16) are associated with at least one magnetic field generator (18) that generates a magnetic field (20) of a selected strength. Varying the magnetic field varies the hardness of each roller (16) to control vibrations of the elevator car (12) to improve ride quality.

16 Claims, 3 Drawing Sheets

U.S. PATENT DOCUMENTS

| | | | | |
|---|---|---|---|---|
| 6,877,587 | B2 * | 4/2005 | Kunz et al. | 187/394 |
| 2002/0130003 | A1 * | 9/2002 | Lisenker et al. | 188/267.2 |
| 2005/0087400 | A1 * | 4/2005 | Zhou | 187/277 |

FOREIGN PATENT DOCUMENTS

| | | | |
|---|---|---|---|
| JP | 63-29613 | | 2/1968 |
| JP | 5-116869 | | 5/1993 |
| JP | 05116869 | A * | 5/1993 |
| JP | 2003-104655 | | 4/2003 |
| WO | WO 2005044710 | A1 * | 5/2005 |

OTHER PUBLICATIONS

Japanese Office Action dated Jul. 1, 2008.

* cited by examiner

ELEVATOR WITH ROLLERS HAVING SELECTIVELY VARIABLE HARDNESS

FIELD OF THE INVENTION

This invention generally relates to a roller guide assembly for an elevator system. More specifically this invention relates to a roller guide having a roller hardness that is selectively variable.

DESCRIPTION OF THE PRIOR ART

Elevator systems typically include a car that moves within a hoistway to transport passengers or items between various levels in a building. Guide rails mounted within the hoistway guide the elevator car within the hoistway. The elevator car includes a plurality of roller guides that guide the car along each guide rail. Inconsistencies in the guide rails can cause unwanted vibrations of the elevator car. In some instances, undesirable vibration requires guide rail realignment. Further, guide rails are fabricated within a specific set of tolerances to provide a desired elevator ride quality. Restrictive tolerances for guide rails require costly fabrication techniques and processes that add to the cost of the elevator system.

Typically, roller guides are mounted to the elevator car with spring or damper assemblies to cushion and absorb some of the inconsistencies present along the guide rail and vibrations transmitted to the elevator car. Such roller guide assemblies can only accommodate a fixed amount of guide rail inconsistency and associated elevator car vibrations. The fixed dampening rate provides optimal ride quality within a limited operational range. Further, the capabilities of springs and dampers to dampen out vibration are constrained by alignment requirements necessitated by increased elevator car speeds. Ride quality for the elevator car is balanced between the desire for a smooth ride and functional elevator parameters such as lift weights and elevator car speeds.

Accordingly, it is desirable to develop a roller guide assembly capable of adapting to vibrations and guide rail inconsistencies to improve elevator ride quality.

SUMMARY OF INVENTION

In embodiment of this invention is a roller guide assembly including a roller having a hardness variable in response to a magnetic field.

In one example, the inventive roller includes a membrane defining a generally annular chamber containing a fluid that changes viscosity characteristics in the presence of an applied magnetic field. A magnetic field generator associated with each roller generates a magnetic field of varying strength to changes viscous properties of the fluid. The variable viscous properties of the fluid result in corresponding changes in roller hardness. A change in roller hardness optimizes dampening characteristics according to currently sensed elevator orientation and operational conditions (i.e., vibrations) to provide improved ride quality.

Accordingly, this invention improves elevator car ride quality by varying roller hardness according to current elevator operating conditions.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
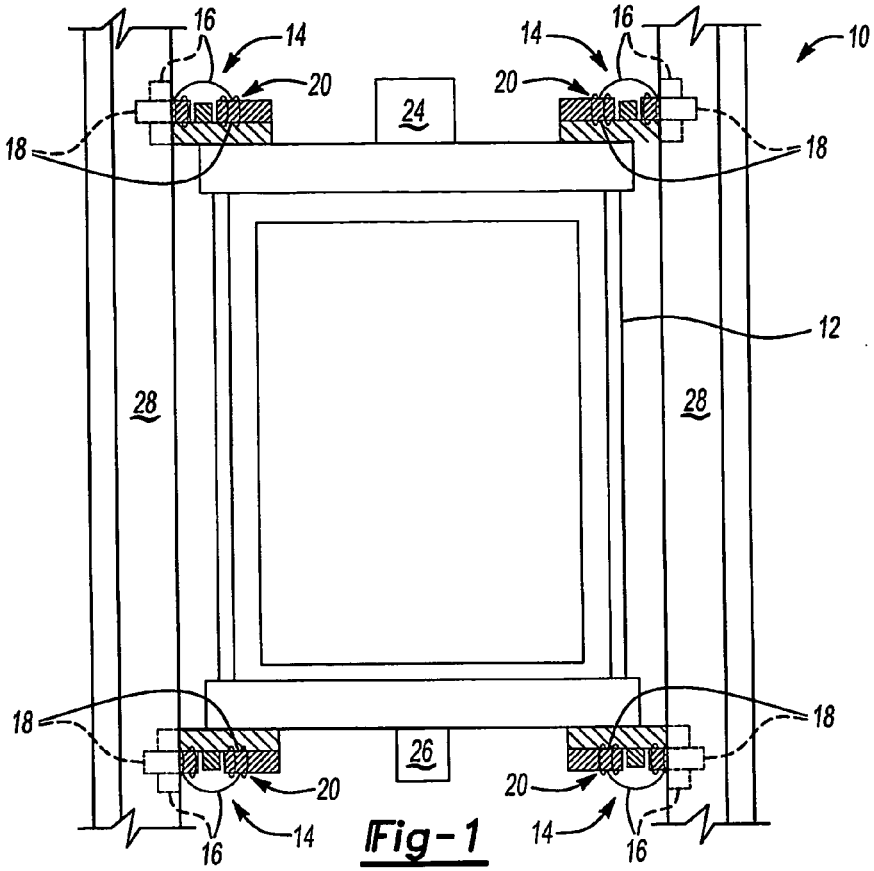
FIG. 1 is a schematic view of an elevator car including example roller guide assemblies designed according to this invention.

Referring to FIG. 1, a roller guide assembly 14 for an elevator system 10 includes a roller 16 having a hardness variable in response to exposure to a magnetic field 20. The roller guide assemblies 14 are supported for movement with a car 12. The rollers 16 are in rolling contact with surfaces of a guide rail 28.

The hardness of each roller 16 varies in response to changes in the magnetic field 20 to counteract vibrations, for example. Vibrations can be caused by inconsistencies in the guide rail 28 or by combinations of speeds and loads transported by the elevator car. Further, lifting motors and other elevator system components can contribute to undesirable vibrations of elevator car 12. Variation in the hardness of each of the rollers 16 adapts to vibrations of varying magnitude to improve ride quality.

A controller 24 is programmed to selectively vary the roller harnesses responsive to the operating conditions. A sensor device 26 is supported to sense vibrations and orientation of the elevator car 12 relative to a desired orientation. The sensor device 26 is preferably an accelerometer for sensing vibrations within the structure of the elevator car 12. Although an accelerometer is used in the illustrated example, any sensing device known in the art may be used for obtaining information on current conditions such as vibrations or orientation of the elevator car 12. Information from the sensor device 26 is provided to the controller 24, which responsively controls the roller harnesses to adjust the ride quality. In the illustrated embodiment the controller 24 is supported for movement with the elevator car 12, however, the controller 24 maybe disposed in any other location.

Given this description, those skilled in the art will be able to program a commercially available controller or to develop dedicated hardware, software of both to achieve the desired roller hardness control to meet their specific needs.

Each roller 16 is disposed adjacent a magnetic field generator 18. The magnetic field generator 18 produces the magnetic field 20. Preferably, each of the plurality of rollers 16 is disposed adjacent a separate corresponding magnetic field generator 18. Separate magnetic field generators 18 for each roller 16 provide independent control of roller hardness for each roller 16.

Figure 2:
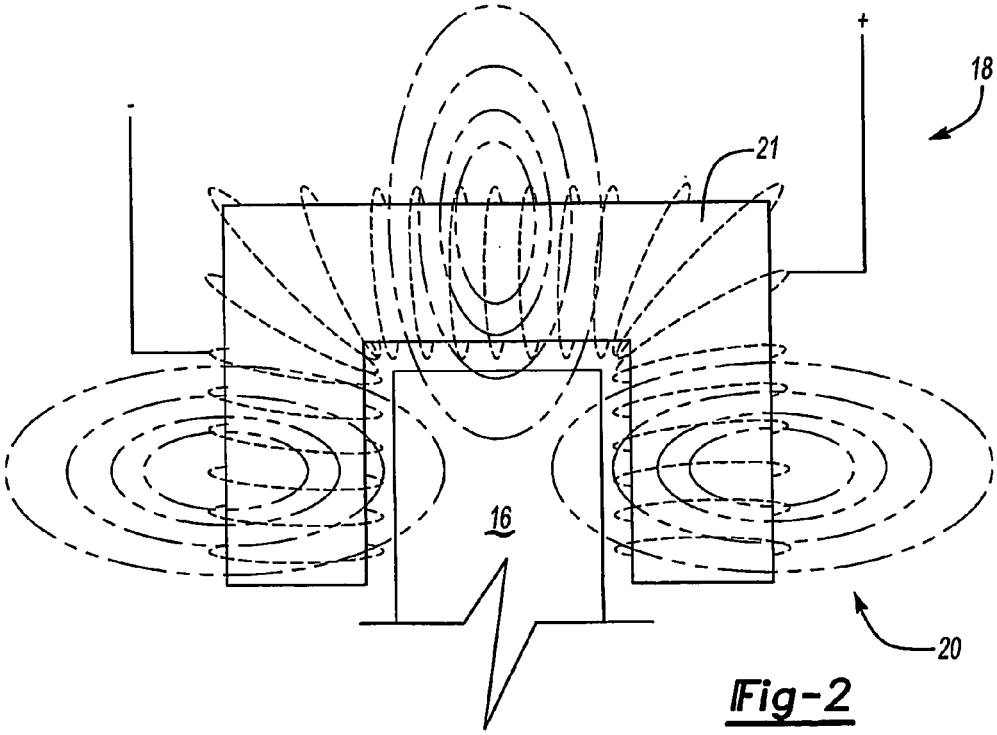
FIG. 2 is a schematic view of an embodiment of a magnetic field generator.

Referring to FIG. 2, in one embodiment, each magnetic field generator 18 comprises an electromagnet 21 configured to create an applied magnetic field 20 of varying strength in a generally known manner. An electromagnet includes a coil energized in proportion to a desired strength of the magnetic field 20. The electromagnet 21 varies field strength in proportion to signals from the controller 24 to change the hardness of the corresponding roller 16.

Figure 3:
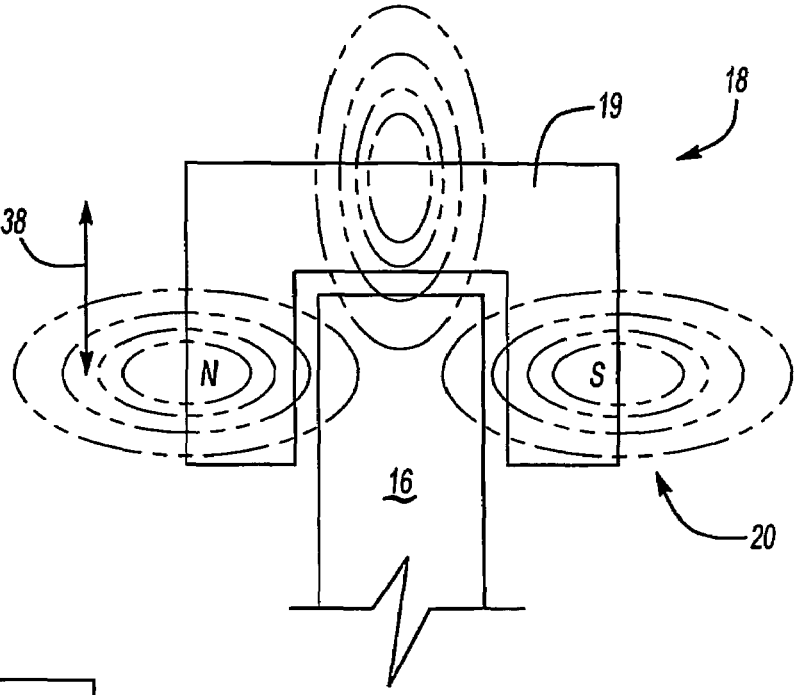
FIG. 3 is a schematic view of another embodiment of a magnetic field generator.

Referring to FIG. 3, in another embodiment, the magnetic field generator 18 comprises a permanent magnet 19. Moving the permanent magnet 19 relative to a roller 16 (as indicated by arrows 38 for example) selectively varies the strength of the magnetic field 20 applied to the roller 16. Although an electromagnet and a permanent magnet are shown as example field generators, it is within the contemplation of this invention to utilize any device configured to produce a varying magnetic field adjacent the rollers 16.

Figure 4:
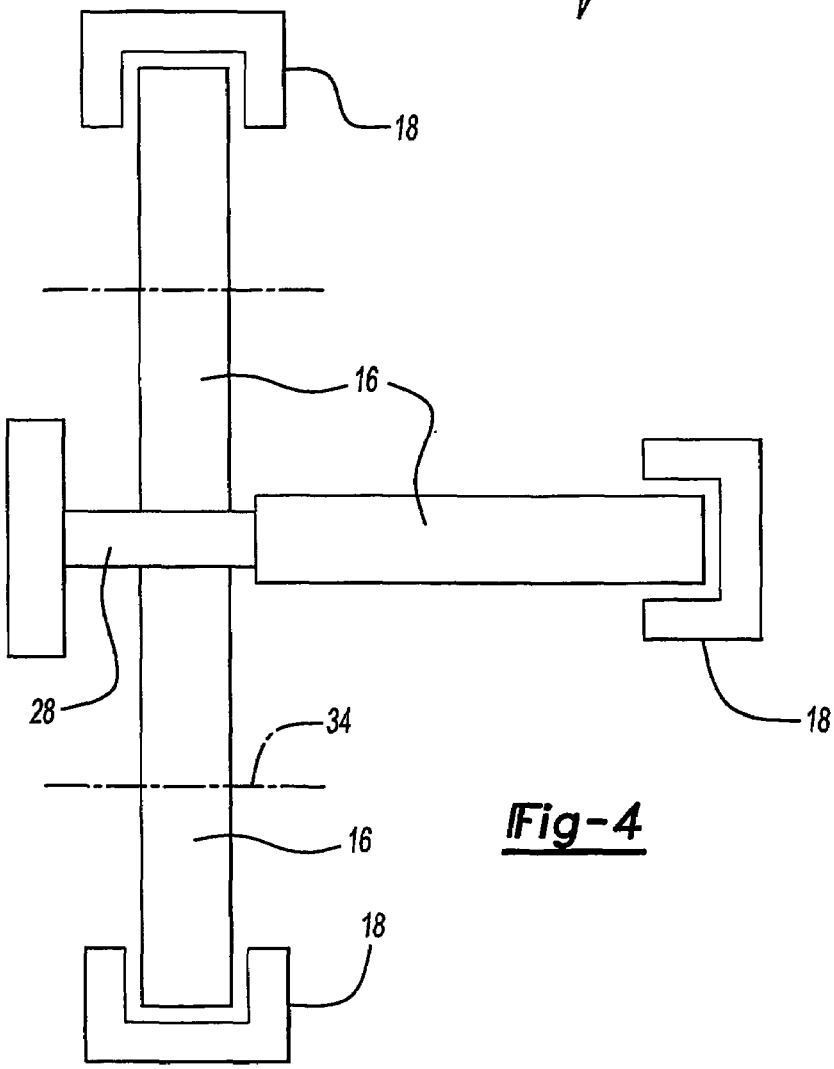
FIG. 4 is a schematic view of a roller guide assembly contacting a guide rail.

Referring to FIG. 4, in one example each roller guide assembly 14 includes three rollers 16 guiding along three surfaces of the guide rail 28. Each of the rollers 16 is supported for rotation about an axis 34. The roller guide assembly 14 guides the elevator car 12 within the hoistway to maintain proper orientation of the elevator car 12 and to provide a smooth, quiet ride. Loads exerted on each of the rollers 16 of any single roller assembly 14 vary with loads on and speeds of the elevator car 12. With this invention, the roller hardness can be optimized to vary the dampening properties of each roller 16 to accommodate and eliminate undesirable vibration, thus improving ride quality.

Figure 5:
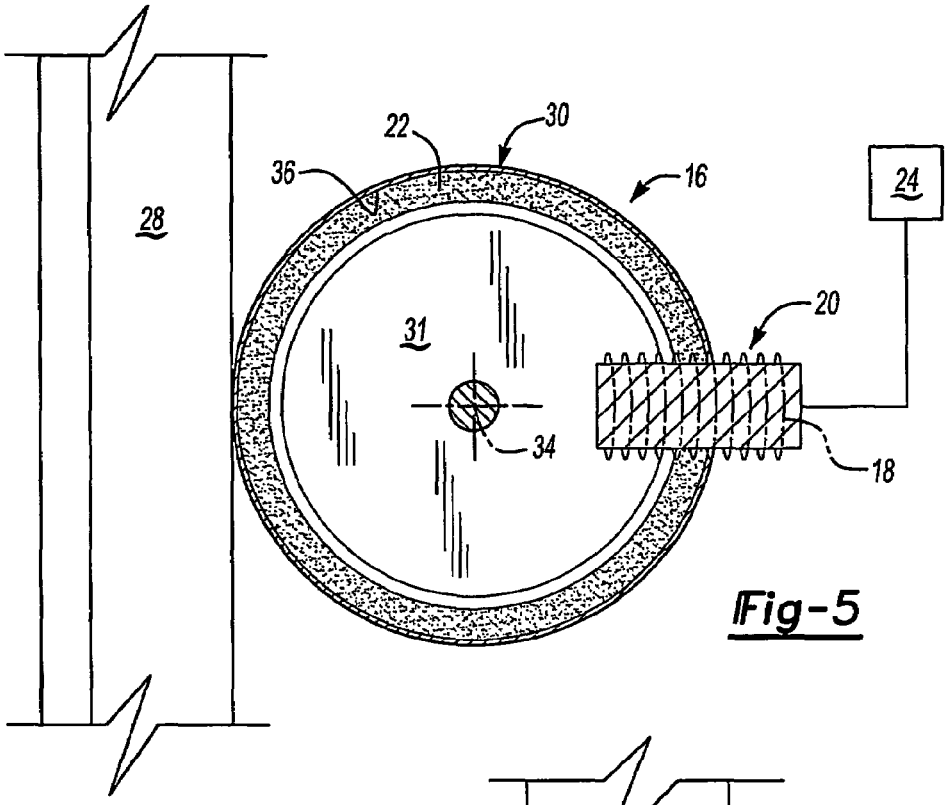
FIGS. 5 and 6 are illustrations of a roller guide designed according to this invention.
Figure 6:
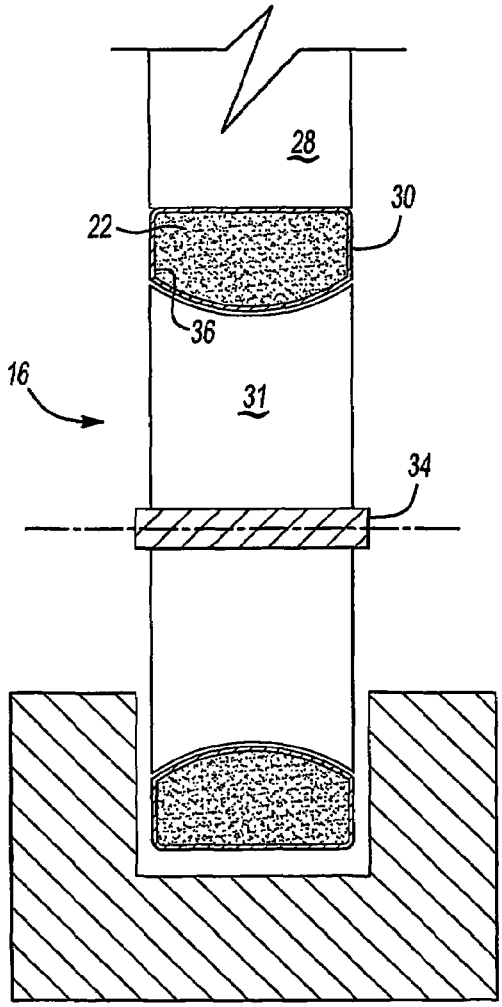

Referring to FIGS. 5 and 6, each roller 16 includes a membrane 30 containing a fluid 22 having a viscosity that changes in response to the changes in strength of an applied magnetic field 20 (FIG. 2 and 3). The fluid 22 in one example comprises a known, magneto-rheological fluid containing suspended particles reactive to the magnetic field 20. The suspended particles within such a fluid form columnar structures parallel to the applied magnetic field 20 in a known manner. Alignment of the columnar structures restrict motion of the fluid 22 to increase fluid viscosity. The change in viscosity of the fluid 22 changes the dampening characteristics of the roller 16.

It is within the contemplation of this invention to utilize any type of fluid responsive to an applied magnetic field to change viscous properties. Those skilled in the art who have the benefit of this description will be able to select magnet-rheological fluids and formulations according to application-specific parameters.

The membrane 30 is supported about a circumference of a solid disk 31 and defines a generally annular cavity 36. The membrane 30 comprises the surface of the roller 16 in guiding contact with the guide rail 28. The fluid 22 within the membrane 30 changes viscous properties in response to proportionate changes in strength of the applied magnetic field 20. Viscosity changes in the fluid 22 results in corresponding changes in hardness of the roller 16 to compensate and dampen vibrations of the elevator car 12.

Referring to FIG. 1, during operation of the elevator system 10, the sensor 26 communicates information indicative of vibration and orientation of the elevator car 12 to the controller 24. The controller 24 compares the information on vibration and orientation from the sensor 26 to desired conditions. The sensing device 26 senses current conditions of the elevator car 12 that result from loads, guide rail inconsistencies, vibrations, speed and many other operational parameters and mechanisms required for the operation of the elevator system 10

The controller 24 compares the sensed condition to a desired condition and responsively controls each magnetic field generator 18 to produce a corresponding magnetic field 20 to control the viscous properties of the fluid 22 and obtain a desired hardness for each roller 16. The strength of the magnetic field 20 is varied for each specific roller 16 in proportion to a difference between the desired condition and a sensed condition. The changing hardness optimizes dampening properties for each roller 16 to dampen and isolate vibrations of the elevator car 12. Further, the controller 24 independently controls the hardness of each roller 16 such that the combined effect of dampening properties results in an optimized, smoother ride.

Operation of the elevator system 10 of this invention reduces the effects of vibration during movement of the elevator car 12 to improve ride quality and reliability. Further, optimization of the selectively variable dampening characteristics of the inventive rollers 16 accommodates a wider variety of guide rails 28.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

The invention claimed is:

1. A roller guide assembly (14) for an elevator system (10) comprising:

a roller (16) having a hardness that varies responsive to a magnetic field (20), wherein the roller (16) includes a membrane (30) containing a fluid (22) having a viscosity that changes responsive to said magnetic field (20).

2. The assembly of claim 1, wherein said fluid (22) comprises a magnet-rheological fluid.

3. The assembly of claim 1, wherein the membrane (30) defines a generally annular chamber (36) supported about a disk (31).

4. The assembly of claim 1, including a magnetic field generator (18) adjacent said roller (16), said magnetic field generator (18) selectively controllable to vary the hardness of said roller (16).

5. The assembly of claim 4, including a plurality of said rollers (16) and a corresponding plurality of separately actuatable magnetic field generators (18).

6. The assembly of claim 4, wherein said magnetic field generator (18) comprises an electromagnet (21).

7. The assembly of claim 4, wherein said magnetic field generator (18) comprises a permanent magnet (19).

8. An elevator system (10) comprising:

at least one guide rail (28);

an elevator car (12) movable along the guide rail (28);

a roller (16) supported for movement with said elevator car (12), said roller (16) rolling along a surface of said guide rail (28) and having a hardness that varies responsive to a magnetic field (20); and a magnetic field generator (18) that selectively generates said magnetic field (20), wherein said roller (16) includes a membrane (30) containing a fluid (22), said fluid (22) having a viscosity that changes responsive to said magnetic field (20).

9. The system of claim 8, wherein said membrane (30) defines a generally annular chamber (36) supported about a disk (31).

10. The system of claim 8, wherein said membrane (30) is in rolling contact with said surface of said guide rail (28).

11. The system of claim 8, including a plurality of rollers (16) and a corresponding plurality of magnetic field generators (18).

12. The system of claim 11, including a controller (24) that selectively and individually controls the magnetic field generators (18).

13. The system of claim 8, including a sensor device (26) that provides information regarding the orientation of said elevator car (12) and a controller (24) that receives information from said sensor device (26) and responsively controls said magnetic field (20) generator to vary said roller hardness.

14. A method of controlling vibration of an elevator car (12) that has an associated plurality of rollers (16) adapted to guide the elevator car (12) along a guide rail (28) comprising the steps of:

a) determining a condition of the elevator car (12) relative to a desired condition;

b) selectively varying a hardness of at least one of the rollers (16) responsive to said determined condition by varying a magnetic field associated with the at least one of the rollers (16); and c) providing the at least one of the rollers (16) with a membrane (30) containing a fluid having a viscosity that changes responsive to the magnetic field.

15. The method of claim 14, including varying the strength of the magnetic field (20) independently for each of the rollers (16).

16. The method of claim 14, wherein step (a) includes determining a level of vibration of the car as the car moves along the guide rail.

* * * * *